US005724676A

United States Patent [19]

Amendolia et al.

[11] Patent Number: 5,724,676

[45] Date of Patent: Mar. 10, 1998

[54] SIZE ADJUSTABLE HAT

[76] Inventors: Dominic Amendolia, 78 Old Cow Pasture La., Kinnelon, N.J. 07405; John Chiarello, 699 Cooper Ave., Oradell, N.J. 07649

[21] Appl. No.: 643,366

[22] Filed: May 6, 1996

[51] Int. Cl.[6] ..... A42B 1/22

[52] U.S. Cl. ..... 2/195.2; 2/183; 2/418

[58] Field of Search ..... 2/181, 181.2, 183, 2/195.2, 209.4, 418, 420

[56] References Cited

U.S. PATENT DOCUMENTS

| | | | |
|---|---|---|---|
| 1,725,425 | 8/1929 | Steingold . | |
| 1,894,213 | 1/1933 | Ostolaza . | |
| 2,106,570 | 1/1938 | Lipton | 2/195.2 |
| 2,869,137 | 1/1959 | Scherz . | |
| 4,011,600 | 3/1977 | Malk | 2/183 |
| 4,023,212 | 5/1977 | Huffman | 2/197 |
| 4,481,681 | 11/1984 | Hankin | 2/197 |
| 4,642,817 | 2/1987 | Ferstenfeld | 2/183 |
| 4,845,782 | 7/1989 | Gregg | 2/172 |
| 4,872,218 | 10/1989 | Holt | 2/171.5 |
| 5,142,705 | 9/1992 | Edwards | 2/418 |
| 5,384,916 | 1/1995 | Portney | 2/195.2 |
| 5,402,538 | 4/1995 | Conrad | 2/195.2 |
| 5,426,789 | 6/1995 | MacLeod | 2/175 |

FOREIGN PATENT DOCUMENTS

| | | |
|---|---|---|
| 404637 | 1/1934 | United Kingdom . |

*Primary Examiner*—Diana Biefeld
*Attorney, Agent, or Firm*—Darby & Darby

[57] ABSTRACT

A hat size adjustment system which has a pair of size adjusting straps with free ends that can be tucked inside slots. Each strap has one end secured to the hat on opposite sides of an opening in the back of the crown. One strap is secured to a sweatband inside the crown. The other strap is secured to an inside lower edge of the crown. The straps are releasably secured to each other by hook and loop fasteners. The free ends of the straps are tucked into slots on each side of the crown opening to present a clean and attractive looking hat size adjustment system. When properly fastened, the size adjustment system appears to be a single strap fixed on both ends.

12 Claims, 2 Drawing Sheets

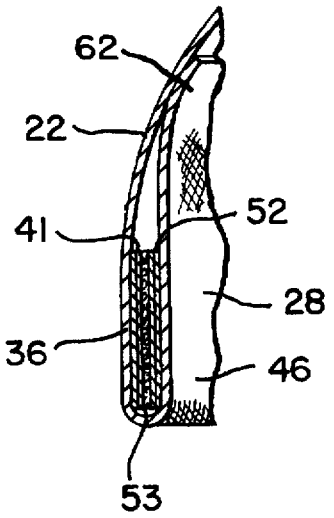
FIG. 3
FIG. 4
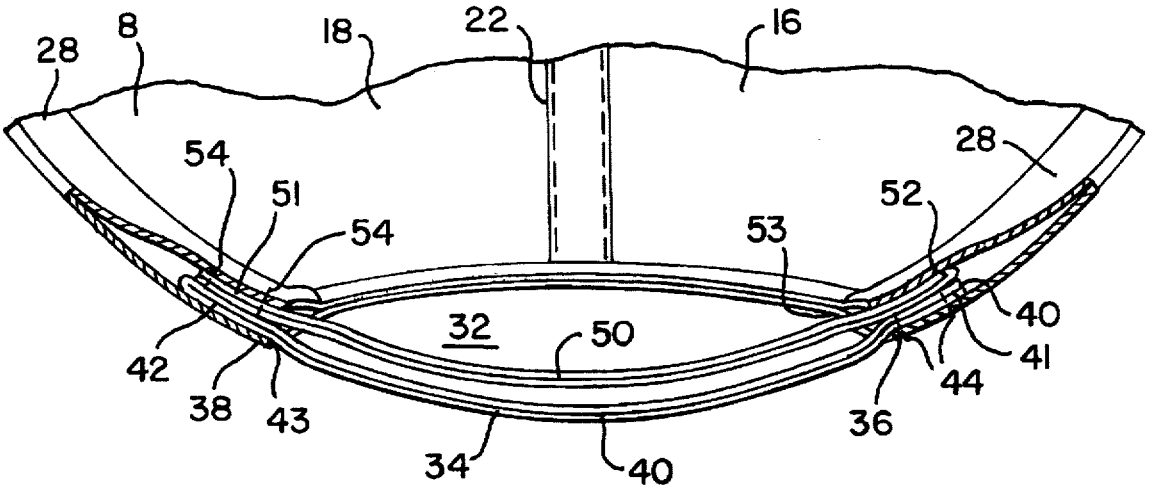
FIG. 5
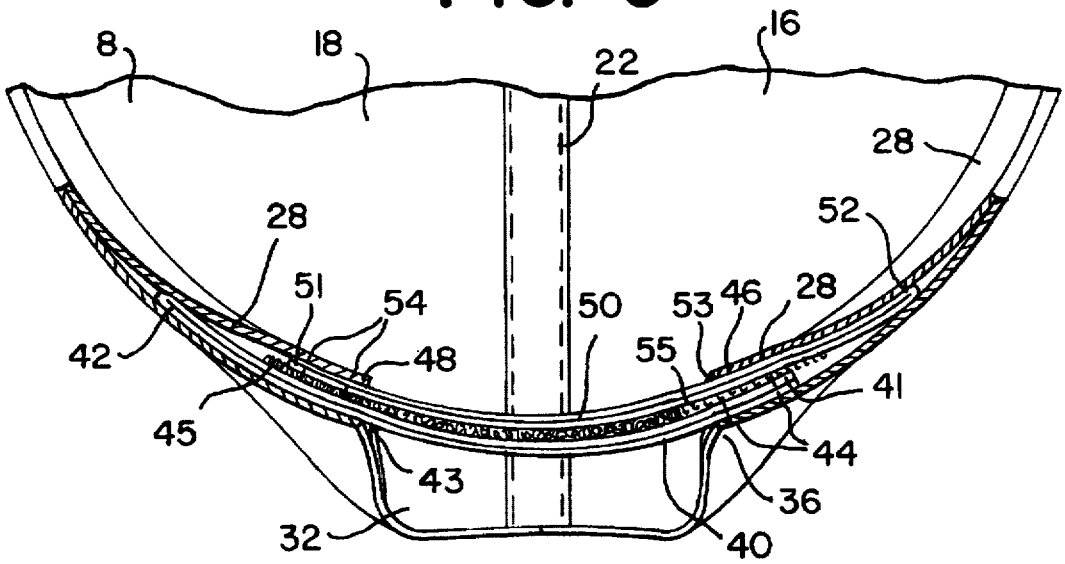

SIZE ADJUSTABLE HAT

The present invention relates to hats and more particularly relates to an improved size adjustment system in size adjustable hats.

In order to accommodate the wide variety of head sizes of people who wear hats, hat manufacturers must either provide hats in a number of predetermined sizes (i.e. "sized"), or must provide hats with means for size adjustment, so that the hat wearer is able to adjust the hat to an appropriate size. Generally, due to the higher cost of manufacturing hats in a number of sizes and providing an inventory of hats in a variety of sizes, "sized" hats are typically the more expensive, higher quality hats.

Size adjustable hats are well known. Particularly popular adjustable hats are baseball style caps, which commonly have a downwardly opening gap in the back portion of the crown. The gap can be constricted or to some degree expanded to adjust the hat size. The gap is generally spanned by an adjustment system which may be fastened in a number of well known ways to maintain the desired hat size. A simple draw string, shoe lace or ribbon secured at each side of the gap and tied in a bow across the gap will adequately secure the cap and provide size adjustment. However, this type of fastener may have the disadvantage of loosening over time and allowing the hat to dislodge. In another adjustment system, overlapping opposite edges of the gap may be directly fastened, without an intermediate strap or member, with a hook and loop fastener, a series of metal or plastic snaps, or a clip. An example of a cap having an overlapping edge system is disclosed in U.S. Pat. No. 4,815,148. In another system, a strap and buckle mechanism is employed to adjust the hat size. However, the buckle may cause discomfort to the hat wearer through undesirable pressure, chaffing or pinching. Another size adjusting system gaining acceptance employs a fabric strap adjustably fastened directly to the cap, or a pair of straps adjustably fastened to each other, by hook and loop fasteners. These straps present a neater, more attractive appearance, particularly when the strap material closely matches the material of the crown of the hat. Fabric straps are also more comfortable to the hat wearer. Examples of baseball caps having fabric strap type adjustment systems can be found, for example, in U.S. Pat. Nos. 5,384,916, and 5,402,538.

Perhaps the most popular size adjusting system currently available employs a pair of molded plastic straps. One strap has a plurality of holes and the other strap has a plurality of studs for releasably, frictionally engaging the holes. This well known construction allows the straps to be connected to each other at a number of positions by repositioning the studs in different holes. This size adjustment system has the disadvantage of adjustments dimensionally restricted by the spacing of the holes and studs and by the number of holes and studs provided on each strap. Also, the plastic straps may be uncomfortable to the cap wearer. Furthermore, the studs and the holes are subject to performance deterioration for example due to exposure to sun, or when subjected to frequent adjustment. The size adjusting system may eventually lose its ability to secure the cap.

Although various hat size adjustment systems have been developed, only a few have gained wide commercial acceptance. The prior art methods of adjusting a baseball style cap do not generally offer the multiple advantages of an adjustment strap which is easy to adjust, adjustable to a wide variety of sizes, comfortable to wear, simple to manufacture and fashionably attractive. In addition, a problem with many commercially available size adjustment systems is the "cheap" appearance the exposed system may provide. This is particularly troublesome since the baseball style cap, formerly popular primarily for example, with recreational, sporting goods, farm supply, heavy equipment and tobacco industries, has taken on new upscale roles not only as fashionable headwear, but as a promotional medium for high class goods and services and as a part of respected dress uniforms.

It is therefore an object of the invention to provide a size adjustable hat which overcomes the deficiencies of the prior art.

A further object of the invention is to provide an improved size adjustment system for headgear such as a cap, a hat or a visor.

A further object of the invention is to provide an adjustment system for headgear which is readily and easily adjusted.

A further object of the invention is to provide an adjustment system for headgear which is precisely adjustable to a wide variety of sizes.

A further object of the invention is to provide an adjustment system for headgear which is comfortable to the wearer.

A further object of the invention is to provide an adjustment system for headgear which is simple and economical to manufacture.

A further object of the invention is to provide an adjustment system for headgear which presents a neat and attractive appearance.

A further object of the invention is to provide an adjustment system for headgear which has the appearance of a more expensive "sized" hat.

SUMMARY OF THE INVENTION

The present invention is employed in a hat having a crown with a size adjustment system. The size adjustment system has a pair of size adjusting straps. Each strap is secured at one end to the hat on opposite sides of an opening in the back of the crown. One strap is secured to a sweatband inside the crown. The other strap is secured to an inside lower margin of the crown. Each strap also has an opposite free end. The straps are detachably secured to each other by hook and loop fasteners. The free ends of the straps are tucked into slots on each side of the crown opening to present a clean and attractive looking hat adjustment system.

BRIEF DESCRIPTION OF THE DRAWINGS

To fully understand the invention, reference is made to the following description taken in connection with the accompanying drawings, in which:

FIG. 3 is a cross-sectional view of the size adjustment system of the hat of the present invention taken along line 3—3 of FIG. 1.

FIG. 4 is a view of the size adjustment system of the hat of the present invention from the bottom, partially cut-away in order to show the overlapping straps, with hook and loop fasteners, secured at a larger hat size to accommodate a user with a larger head size.

FIG. 5 is a view of the size adjustment system of the hat of the present invention from the bottom, partially cut-away in order to show the overlapping straps, with hook and loop fasteners, secured at a smaller hat size to accommodate a user with a smaller head.

DETAILED DESCRIPTION

Figure 1:
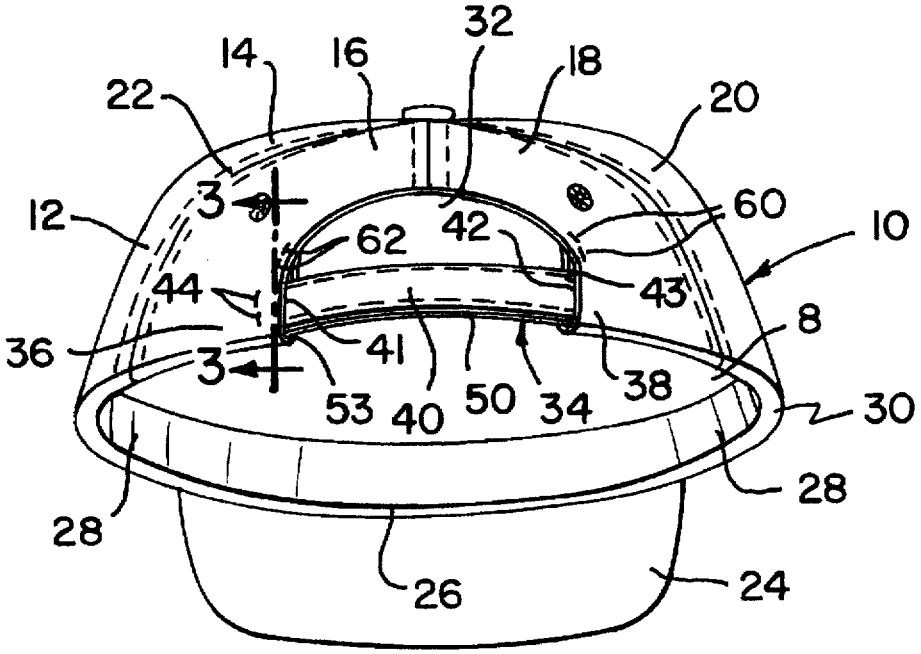
FIG. 1 is a bottom and rear perspective view of the hat of the present invention showing the size adjustment system in its secured position.
Figure 2:
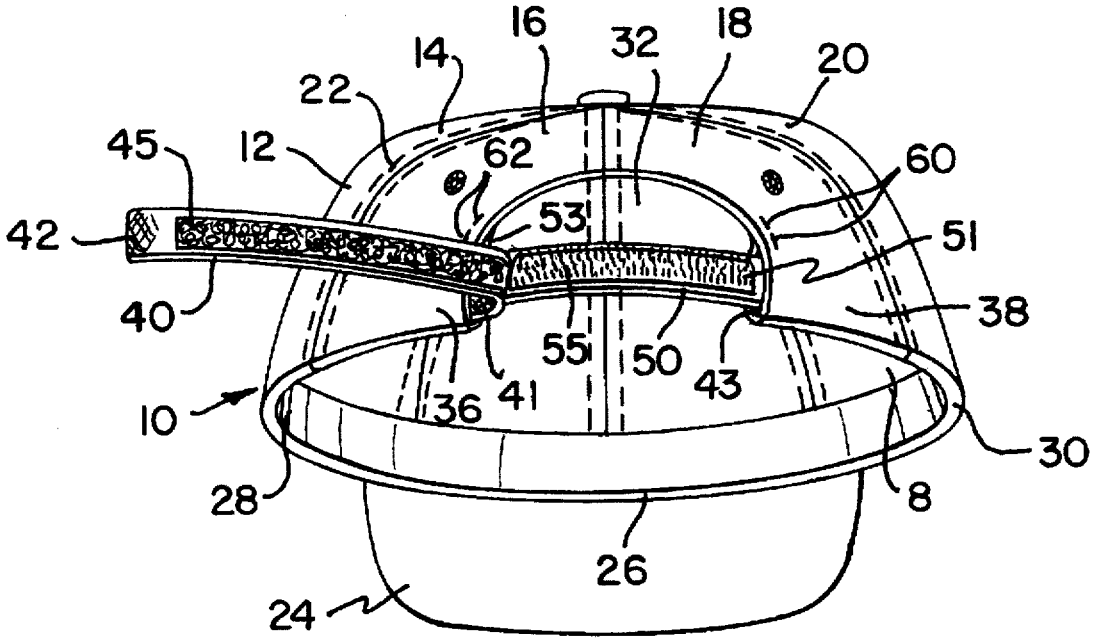
FIG. 2 is a bottom and rear perspective view of the hat of the present invention showing the size adjustment system with an outer adjustment strap opened.

Referring to FIGS. 1 to 5, a hat 10, in accordance with the invention, is shown having a crown 12 with a hollow hemi-spherical shape which is conventionally constructed from a number of fabric panels 14, 16, 18 and 20 interconnected by stitches along seams 22. A lower margin 30 of the crown 12 defines a head opening 8 for receiving the head of the wearer. A crescent shaped visor 24 may be secured to the crown 12 at the front 26 of the hat 10. A sweatband 28 extends around the inner periphery of the crown 12 and is attached to the crown 12 proximate to its lower margin 30.

At the rear or back of the hat 10 is a crown opening 32. The crown lower margin 30 is interrupted by the crown opening 32 between a left lower margin end 36 and a right lower margin end 38. The sweatband 28 is similarly interrupted by the crown opening 32 between a left sweatband end 46 and a right sweatband end 48.

By changing the distance between the left and right lower margin ends, 36 and 38 respectively, thereby changing the shape and size of the crown opening 32, the inside circumference of the head opening 8 can be adjusted so that the hat 10 can fit a variety of head sizes. As described in detail below, a size adjustment system 34 operates to maintain the selected size of the head opening 8.

A vertically oriented outer receiving slot 43 having a laterally outwardly directed opening, is formed between the inside surface of the right lower margin end 38 and the inside surface of the right sweatband end 48. A lower end of the opening of the outer receiving slot 43 is formed proximate to the lower margin 30 of the crown 12 approximately where the sweatband 28 attaches to the crown 12. An upper end of the opening of the outer receiving slot 43 is provided by securing the upper margin of the right sweatband end 48 to the inside of the crown 12, proximate to the edge of the crown opening 32, by, for example, reinforcing stitches 60.

A vertically oriented inner receiving slot 53 having a laterally outwardly directed opening, is formed between the inside surface of the left lower margin end 36 and the inside surface of the left sweatband end 46. A lower end of the opening of the inner receiving slot 53 is formed proximate to the lower margin 30 of the crown 12 approximately where the sweatband 28 attaches to the crown 12. An upper end of the opening of the inner receiving slot 53 is provided by securing the upper margin of the left sweatband end 46 to the inside of the inside of the crown 12, proximate to the edge of the crown opening 32, by, for example, reinforcing stitches 62.

The size adjustment system 34 spans the crown opening 32 from the left lower margin end 36 to the right sweatband end 48. The size adjustment system 34 includes an elongated outer adjustment strap 40 releasably engaged with an adjacent elongated inner adjustment strap 50. The inner adjustment strap 50 extends adjacent to and in general longitudinal alignment with the outer adjustment strap 40, with the opposite broad surfaces of each strap facing inwardly and outwardly relative to the head of the user. The outer adjustment strap 40 is wider in the transverse dimension than the inner adjustment strap 50, so that, when the straps 40 and 50 are properly engaged only the outer strap 40 is outwardly visible. Because the inner strap 50 is not visible, the adjustment system 34 appears to consist of only one strap 40. Furthermore, as explained in detail below, a free end 42 of the outer strap 40 is capable of being received in the outer receiving slot 43, so that the adjustment system 34 has the appearance of a fixed strap of a "sized" hat.

The outer and inner adjustment straps, 40 and 50 respectively, may be constructed of two fabric layers stitched or fastened together in a conventional manner. A hook fastener strip 55 is secured in a conventional manner along a substantial portion of the outwardly facing surface of the inner adjustment strap 50. A loop fastener strip 45 is secured in a conventional manner along a substantial portion of the inwardly facing surface of the outer adjustment strap 40. The loop fastener strip 45 attached to the outer adjustment strap 40 cooperates with the hook fastener strip 55 attached to the inner adjustment strap 50 to provide adjustable releasable locking engagement. Such hook and loop fasteners 55 and 45 operate in a manner well known to the public at large and are generally identified by the public as "VELCRO" fasteners. Hook and loop fasteners are preferred because of their precise and variable adjustment ability, ease of use, and strong and secure interengagement capability. However, as will be appreciated by those skilled in the art, other means for providing adjustable releasable locking engagement may be used, such as, for example, single or multiple plastic or metal snaps, or plastic studs and anchors.

The straps 40 and 50 are preferably made from the same fabric as the crown 12, but may also be made from fabrics different from the crown 12 or may be made from alternative materials, such as, for example, plastic or leather. The inner strap 50 may be made of the same fabric or material as the outer strap 40, or may be made of a different material, such as, for example, a fabric similar to or the same as the fabric of the sweatband 28, to provide additional comfort to the wearer. The inner adjustment strap 50 is particularly noteworthy because it may be constructed of a soft, comfortable fabrics on the surface adjacent the wearer's head. Furthermore, when the straps 40 and 50 are properly engaged, the inner strap 50 prevents the hook and the loop fastener strips 55 and 45 from contacting a wearer. Thus the hook and loop fastener strips 55 and 45 will not interfere or engage the hair of a wearer and the stiff, sometimes abrasive edge of the hook and loop fastener strips 55 and 45 are prevented from causing discomfort to a wearer.

Outer adjustment strap 40 has a secured end 41 and a free end 42. The secured end 41 is attached to the inner periphery of the crown 12 inside the inner receiving slot 53 by conventional means, such as, for example, outer stitches 44. Inner adjustment strap 50 has a secured end 51 and a free end 52. The secured end 51 of the inner adjustment strap 50 is secured to the inside surface of the sweatband 28 inside the outer receiving slot 43 by conventional means, such as, for example, stitches 54. The free ends 42 and 52 of the outer adjustment strap 40 and the inner adjustment strap 50, respectively, extend substantially beyond the fastening means 45 and 55.

The elongated outer adjustment strap 40 extends laterally from its mounting point within the inner receiving slot 53 towards the outer receiving slot 43. The free end 42 of the outer adjustment strap 40 is capable of being received in the outer receiving slot 43, between the inside surface of the crown 12, and the outside surface of the secured end 51 of the inner adjustment strap 50. Referring to FIG. 4, when the circumference of the head opening 8 approaches a large size, the free end 42 of the outer adjustment strap 40 is capable of being located adjacent to the mounting point of the secured end 51 of the inner adjustment strap 50. Referring to FIG. 5, when the circumference of the head opening 8 is at a size adjustment substantially less than a large hat size adjustment, the free end 42 of the outer adjustment strap 40 is located beyond the mounting point of the secured end 51 of the inner adjustment strap 50. The free end 42 is now located between the lower periphery of the crown 12 and the sweatband 28.

The elongated inner adjustment strap 50 extends laterally from its mounting point on the right sweatband end 48 within the outer receiving slot 43 towards the inner receiving slot 53. The free end 52 of the inner adjustment strap 50 is capable of being received in the inner receiving slot 53, between the inside surface of the secured end 41 of the outer adjustment strap 40 and the inside surface of the sweatband 28 at the left sweatband end 46. Referring to FIG. 4, when the circumference of the head opening 8 approaches a large size, the free end 52 of the inner adjustment strap 50 is capable of being located adjacent to the mounting point of the secured end 41 of the outer adjustment strap 40. Referring to FIG. 5, when the circumference of the head opening 8 is at a size substantially less than a large hat size, the free end 52 of the inner adjustment strap 50 is located beyond the mounting point of the secured end 41 of the outer adjustment strap 40. The free end 52 is now located between the lower periphery of the crown 12 and the sweatband 28.

To adjust the hat to an appropriate size, a user disengages the size adjustment straps 40 and 50, to which the user has free access since the straps 40 and 50 are substantially exposed in the crown opening 32. The user then precisely adjusts and re-engages the straps 40 and 50. After re-engaging the straps 40 and 50, the user inserts the free end 42 of outer adjustment strap 40 into outer receiving slot 43, and inserts the free end 52 of inner adjustment strap 50 into inner receiving slot 53.

Because the free ends 42 and 52 of the adjusting straps 40 and 50 are inserted in the corresponding slots 43 and 53, the adjustment system 34 appears to be a single, non-adjustable strap more commonly found on a higher-priced "sized" hat. The adjustment system 34 with free ends 42 and 52 hidden in corresponding slots 43 and 53 presents a clean and neat appearance. Furthermore, the fabric used to construct at least the adjustment strap 40 may be fashionably coordinated with the fabric of the crown 12 to provide a more attractive "upscale" appearance desirable in headwear today.

It will be understood by one skilled in the art, that although the present invention is described above in relation to a hat having an opening in the crown, the invention can also be employed to improve the appearance of other headgear with an opening or gap in the rear of the crown, such as, for example, a visor.

We claim:

1. A size adjustable hat having a crown and a sweatband lying along an inner surface of the crown, the sweatband secured along a lower internal periphery of the crown, the crown having a downwardly directed crown opening at the back of the crown, the hat having a size adjustment system extending across the crown opening comprising:

an inner strap having a secured end and a free end, the secured end secured in a fixed position to the sweatband proximal to a margin of the crown opening and proximal to the lower periphery of the crown, the free end of the inner strap extending toward an opposite margin of the crown opening proximal to the lower periphery of the crown;

an outer strap extending adjacent to and in general longitudinal alignment with the inner strap, the outer strap having a secured end and a free end, the secured end secured in a fixed position on an opposite side of the crown opening from the secured end of the inner strap, the outer strap secured end secured to the crown proximal to a margin of the crown opening and proximal to the lower periphery of the crown, the free end of the outer strap extending through a first complementary shaped slot provided between the lower periphery of the crown and the sweatband on an opposite side of the crown opening from the fixed end of the outer strap in order to allow the free end of the outer strap to pass through the first complementary shaped slot for positionment between the sweatband and the lower periphery of the crown; and cooperating flexible universally adjustable means for releasably engaging the inner strap to the outer strap in a transverse plane.

2. The size adjustable hat of claim 1, wherein the free end of the inner strap extends through a second complementary shaped slot provided between the lower periphery of the crown and the sweatband on an opposite side of the crown opening from the fixed end of the inner strap in order to allow the free end of the inner strap to pass through the second complementary shaped slot for positionment between the sweatband and the lower periphery of the crown.

3. The size adjustable hat of claim 2 wherein the inner strap secured end is secured to the sweatband inside the first complementary shaped slot.

4. The size adjustable hat of claim 3 wherein the outer strap secured end is secured to the inner surface of the crown inside the second complementary shaped slot.

5. The size adjustable hat of claim 2 wherein the sweatband is secured to the crown at an upper margin of the sweatband proximate the second complementary shaped slot.

6. The size adjustable hat of claim 5 wherein the sweatband is secured to the crown at an upper margin of the sweatband proximate the first complementary shaped slot.

7. The size adjustable hat of claim 1 wherein the outer strap secured end is secured to the inner surface of the crown inside a second complementary shaped slot, said second complementary shaped slot provided between the lower periphery of the crown and the sweatband on an opposite side of the crown opening from the fixed end of the inner strap.

8. The size adjustable hat of claim 1 wherein the sweatband is secured to the crown at an upper margin of the sweatband proximate the first complementary shaped slot.

9. The size adjustable hat of claim 1 wherein the means for adjustably, releasably engaging the inner strap to the outer strap comprises a hook and loop fastening means.

10. The size adjustable hat of claim 9 wherein a hook means is secured to an outwardly facing surface of the inner strap and a loop means is secured to an inwardly facing surface of the outer strap.

11. The size adjustable hat of claim 1 wherein a strip of fabric material covers a outwardly facing surface of the outer strap.

12. The size adjustable hat of claim 1 wherein the outer strap has a width wider than the width of the inner strap.

* * * * *